US008297958B2

(12) United States Patent
Duppert

(10) Patent No.: US 8,297,958 B2
(45) Date of Patent: Oct. 30, 2012

(54) OPTIMIZED DISCHARGE PORT FOR SCROLL COMPRESSOR WITH TIP SEALS

(75) Inventor: Ronald J. Duppert, Fayetteville, NY (US)

(73) Assignee: Bitzer Scroll, Inc., Syracuse, NY (US)

( * ) Notice: Subject to any disclaimer, the term of this patent is extended or adjusted under 35 U.S.C. 154(b) by 492 days.

(21) Appl. No.: 12/557,592

(22) Filed: Sep. 11, 2009

(65) Prior Publication Data

US 2011/0064597 A1 Mar. 17, 2011

(51) Int. Cl.
*F03C 2/00* (2006.01)
*F03C 4/00* (2006.01)
*F04C 2/00* (2006.01)

(52) U.S. Cl. ..... 418/55.4; 418/55.1; 418/55.2; 418/142

(58) Field of Classification Search ..... 418/55.1–55.6, 418/57, 142
See application file for complete search history.

(56) References Cited

U.S. PATENT DOCUMENTS

| | | | | |
|---|---|---|---|---|
| 4,594,061 | A * | 6/1986 | Terauchi | 418/55.2 |
| 5,222,882 | A * | 6/1993 | McCullough | 418/55.2 |
| 6,398,530 | B1 | 6/2002 | Hasemann | |
| 6,814,551 | B2 | 11/2004 | Kammhoff et al. | |
| 6,960,070 | B2 | 11/2005 | Kammhoff et al. | |
| 7,112,046 | B2 | 9/2006 | Kammhoff et al. | |
| 2006/0269432 | A1 * | 11/2006 | Lifson | 418/55.1 |
| 2009/0185921 | A1 | 7/2009 | Beagle et al. | |
| 2009/0185926 | A1 | 7/2009 | Bush | |
| 2009/0185927 | A1 | 7/2009 | Duppert et al. | |
| 2009/0185928 | A1 | 7/2009 | Bush | |
| 2009/0185929 | A1 | 7/2009 | Duppert et al. | |
| 2009/0185930 | A1 | 7/2009 | Duppert et al. | |
| 2009/0185931 | A1 | 7/2009 | Beagle et al. | |
| 2009/0185932 | A1 | 7/2009 | Beagle et al. | |
| 2009/0185933 | A1 | 7/2009 | Bush et al. | |
| 2009/0185934 | A1 | 7/2009 | Bush | |

FOREIGN PATENT DOCUMENTS

JP 06042471 A * 2/1994

(Continued)

OTHER PUBLICATIONS

U.S. Appl. No. 12/250,688, filed Oct. 14, 2008, Duppert.
U.S. Appl. No. 12/250,696, filed Oct. 14, 2008, Duppert.

(Continued)

*Primary Examiner* — Theresa Trieu
(74) *Attorney, Agent, or Firm* — Reinhart Boerner Van Deuren P.C.

(57) ABSTRACT

A scroll compressor having a first compressor body with a first base, a first rib that projects from the first base, and a discharge port. A second compressor body has a second base and a second rib projecting from the second base. The first and second ribs are mutually received in each other to define at least one compression chamber between an intake and discharge port. The relative movement between the first and second compressor bodies is adapted to compress fluid from the intake to the discharge port. The scroll compressor further includes a tip seal projecting axially from the second rib. The tip seal is adapted to engage the first base to seal the compression chamber. The discharge port includes an inward-facing radius, which enables the length of the tip seal in the vicinity of the discharge port to be greater than it would be without the inward-facing radius.

18 Claims, 10 Drawing Sheets

FOREIGN PATENT DOCUMENTS

| | | | |
|---|---|---|---|
| JP | 08-004670 | | 1/1996 |
| JP | 08-267613 | | 10/1996 |
| JP | 2000170673 | A * | 6/2000 |
| JP | 2006-152930 | | 6/2006 |

OTHER PUBLICATIONS

U.S. Appl. No. 12/409,091, filed Mar. 23, 2009, Bush.
U.S. Appl. No. 12/418,326, filed Apr. 3, 2009, Wilson.

* cited by examiner

OPTIMIZED DISCHARGE PORT FOR SCROLL COMPRESSOR WITH TIP SEALS

FIELD OF THE INVENTION

The present invention generally relates to scroll compressors for compressing refrigerant and more particularly relates to sealing between the scroll compressor bodies of such scroll compressors, and the discharge of compressed fluid from the scroll compressor bodies.

BACKGROUND OF THE INVENTION

A scroll compressor is a type of compressor that is used to compress refrigerant for various applications, such as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors conventionally include an outer housing having a scroll compressor contained therein. A scroll compressor generally includes first and second scroll compressor members. The first compressor member is typically configured to be relatively stationary and fixed in the outer housing with respect to the second scroll compressor member. The second scroll compressor member is configured to be moveable relative to the first scroll compressor member in order to compress refrigerant between respective scroll ribs which rise above the respective bases. In this configuration, the scroll ribs are configured to engage the base of the other compressor member. Conventionally, the second, or moveable, scroll compressor member is driven about an orbital path about a central axis for the purposes of compressing refrigerant, which is discharged through a discharge port at the center of the first scroll compressor member. An appropriate drive unit, typically an electric motor, is provided usually within the same housing to drive the movable scroll member.

As exemplified, for example in U.S. Pat. No. 7,112,046, the tips of the spiraling scroll ribs of the respective scroll compressor bodies may define axially extending, spiral grooves in which are situated spiral tip seals that engage upon the base of the other scroll compressor body (see e.g. FIG. 7 of the '046 patent showing a groove for the tip seal). Such tip seals provide an axial compression seal between the scroll tips of one scroll compressor body and the base of the other scroll compressor body so as to generally prevent compressed fluid leakage from an inner compression chamber which has a higher compressed state to an outer chamber defined as being on the perimeter side of the scroll rib, which has a lower compressed state.

Typically, the scroll tip seals are highly efficient and provide for very good sealing capabilities, and thereby maintain a high compression efficiency. However, as may become apparent from the application, tip seals unfortunately suffer from efficiency losses at the inner portion of the spiral scroll rib and around the terminating end of the tip seal proximate the discharge port.

The present invention is directed towards improvements over the state of the art.

BRIEF SUMMARY OF THE INVENTION

The present invention is generally directed toward providing a scroll compressor member with an optimized discharge port. There are several aspects that may be used for achieving the foregoing that stand as patentable individually or in combination including but not limited to the following.

Generally, one aspect of the present invention is the provision for extending the tip seal of a scroll tip compressor body into the conventional discharge port region while accommodating such tip seal expansion by a shape change incorporating a receding region in the discharge port. Overall efficiency gains may or can be realized due to sealing efficiency improvements, despite some loss due to the reduction in the size of the discharge port.

One more detailed aspect of the present invention provides a scroll compressor having a first compressor body with a first base, a first rib that projects from the first base, and a discharge port. A second compressor body has a second base and a second rib projecting from the second base. The first and second ribs are mutually received in each other to define at least one compression chamber between an intake and discharge port. The relative movement between the first and second compressor bodies is adapted to compress fluid from the intake to the discharge port. The scroll compressor further includes a tip seal projecting axially from the second rib. The tip seal is adapted to engage the first base to seal the compression chamber. The discharge port includes an inward-facing radius, which enables the length of the tip seal in the vicinity of the discharge port to be greater than it would be without the inward-facing radius.

Another different detailed aspect of the present invention provides a scroll compressor for compressing fluid that includes a first scroll compressor body having a first base, a first scroll rib projecting from the first base, and a discharge port. The first scroll rib has a terminating end at the discharge port, while the discharge port has a vertex generally at the terminating end. The scroll compressor further includes a second scroll compressor body having a second base and a second scroll rib projecting from the second base. The first and second bases are axially spaced apart, and the first and second scroll ribs are mutually received in each other to define at least one compression chamber between an intake region and the discharge port. The relative movement between the first and second scroll compressor bodies is adapted to compress fluid from the intake region to the discharge port. A tip seal projects axially from the second scroll rib and is adapted to sealingly engage the first base for sealing the at least one compression chamber. The tip seal has a seal tip end proximate the discharge port and has a scroll tip seal path during the relative movement in spaced relation to the discharge port. Further, the discharge port has a first edge portion that extends away from the vertex along the inside of the first scroll rib generally following a curvature of the first scroll rib. The discharge port also has a second edge portion that extends away from the vertex. The second edge portion has a receding region, as compared to the first edge portion. The receding region is in close proximity to the scroll tip seal path to accommodate sweeping movement of the tip seal.

In yet another aspect, the present invention provides a scroll compressor for compressing fluid having a first scroll compressor body that includes a first base, a first scroll rib projecting from the first base, and a discharge port. The scroll compressor also has a second scroll compressor body that includes a second base and a second scroll rib projecting from the second base. The first and second bases are axially spaced apart. The first and second scroll ribs are mutually received in each other to define at least one compression chamber between an intake region and the discharge port. The relative movement between the first and second scroll compressor bodies is adapted to compress fluid from the intake region to the discharge port. Further, the scroll compressor includes a tip seal that projects axially from the second scroll rib and is adapted to sealingly engage the first base for sealing the at least one compression chamber. The scroll compressor also has means formed into the discharge port for accommodating a sweeping movement of the tip seal into a conventional discharge port region, which enables tip seal lengthening on the second scroll rib.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

All references, including publications, patent applications, and patents cited herein are hereby incorporated by reference to the same extent as if each reference were individually and specifically indicated to be incorporated by reference and were set forth in its entirety herein.

Figure 9:
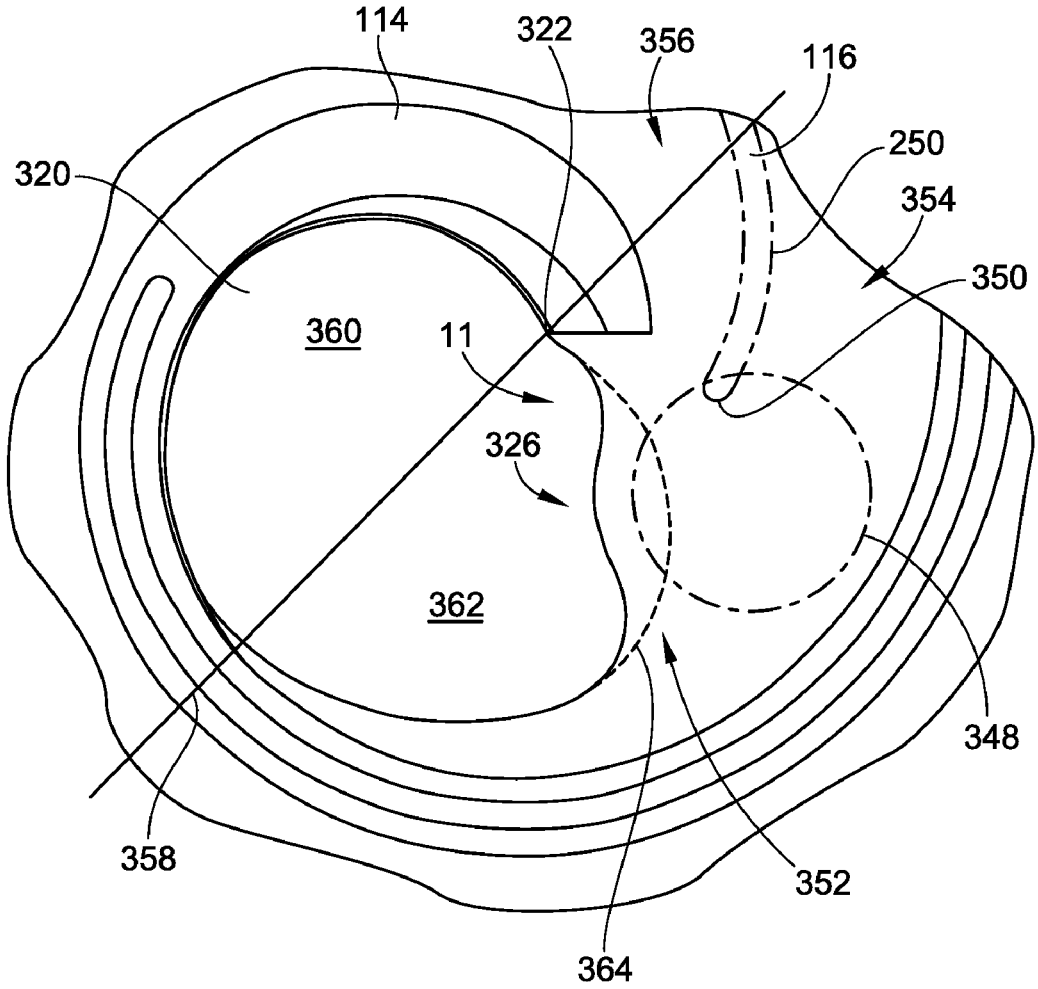
FIG. 9 is an illustration of the optimized discharge port showing the orbiting scroll tip seal path according to an embodiment of the present invention.

An embodiment of the present invention is illustrated in the figures as a scroll compressor assembly 10 including an improved tip sealing and discharge port arrangement 11 as shown in FIG. 9. Before turning to greater detail of this arrangement, details will first be provided more generally about the scroll compressor assembly 10.

Figure 1:
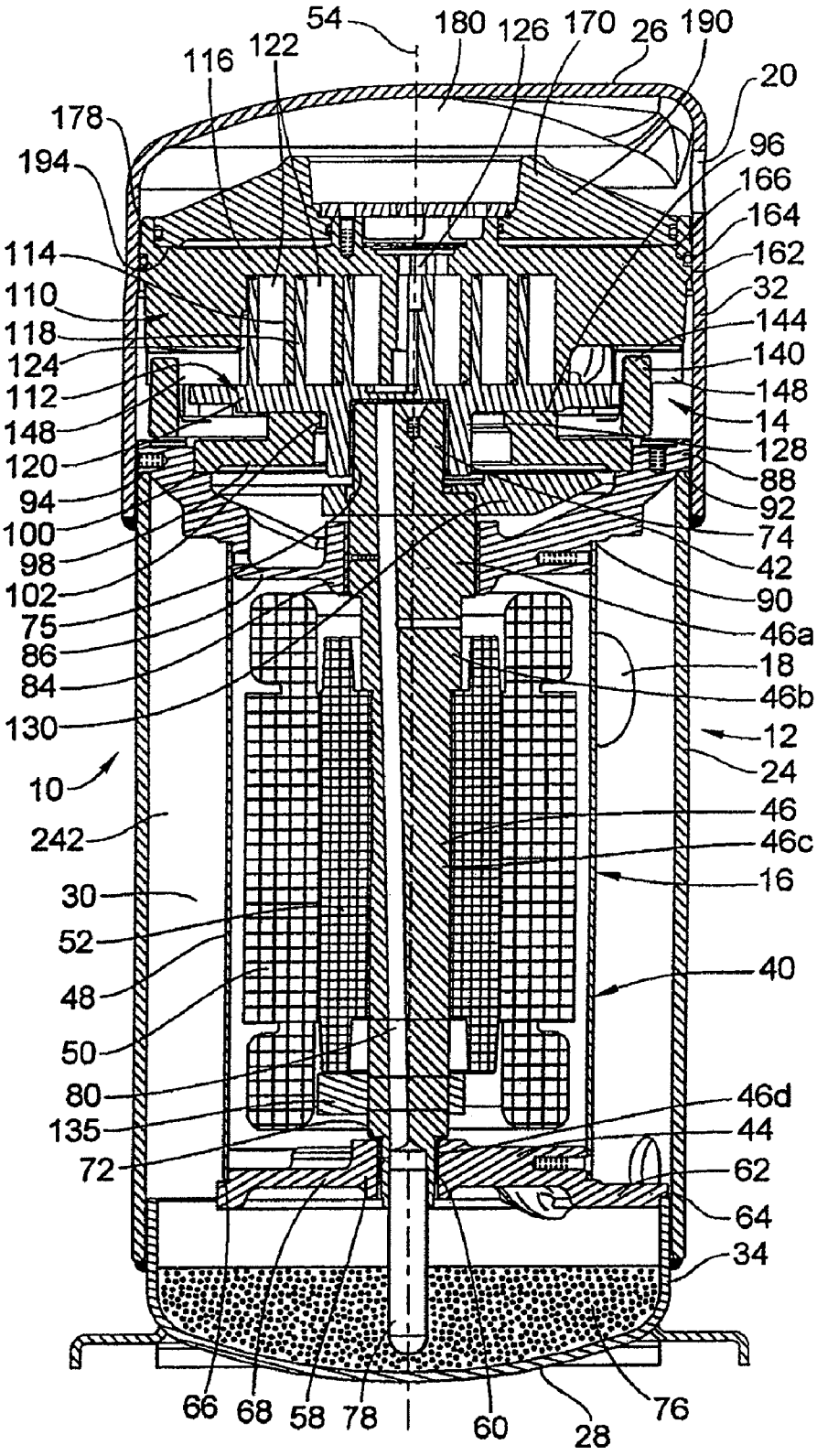
FIG. 1 is a cross section of a scroll compressor assembly in accordance with an embodiment of the present invention.

The scroll compressor 10 generally includes an outer housing 12 in which a scroll compressor 14 can be driven by a drive unit 16. Referring to FIG. 1, the scroll compressor assembly may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high pressure state.

The outer housing 12 may take many forms. In the preferred embodiment, the outer housing includes multiple shell sections and preferably three shell sections to include a central cylindrical housing section 24, a top end housing section 26 and a bottom end housing section 28. Preferably, the housing sections 24, 26, 28 are formed of appropriate sheet steel and welded together to make a permanent outer housing 12 enclosure. However, if disassembly of the housing is desired, other housing provisions can be made that can include metal castings or machined components.

The central housing section 24 is preferably cylindrical and telescopically interfits with the top and bottom end housing sections 26, 28. This forms an enclosed chamber 30 for housing the scroll compressor 14 and drive unit 16. Each of the top and bottom end housing sections 26, 28 are generally dome shaped and include respective cylindrical side wall regions 32, 34 to mate with the center section 24 and provide for closing off the top and bottom ends of the outer housing 12. As can be seen in FIG. 1, the top side wall region 32 telescopically overlaps the central housing section 24 and is exteriorly welded along a circular welded region to the top end of the central housing section 24. Similarly the bottom side wall region 34 of the bottom end housing section 28 telescopically interfits with the central housing section 24 (but is shown as being installed into the interior rather than the exterior of the central housing section 24) and is exteriorly welded by a circular weld region.

The drive unit 16 may preferably take the form of an electrical motor assembly 40, which is supported by upper and lower bearing members 42, 44. The motor assembly 40 operably rotates and drives a shaft 46. The electrical motor assembly 40 generally includes an outer annular motor housing 48, a stator 50 comprising electrical coils and a rotor 52 that is coupled to the drive shaft 46 for rotation together. Energizing the stator 50 is operative to rotatably drive the rotor 52 and thereby rotate the drive shaft 46 about a central axis 54.

Figure 4:
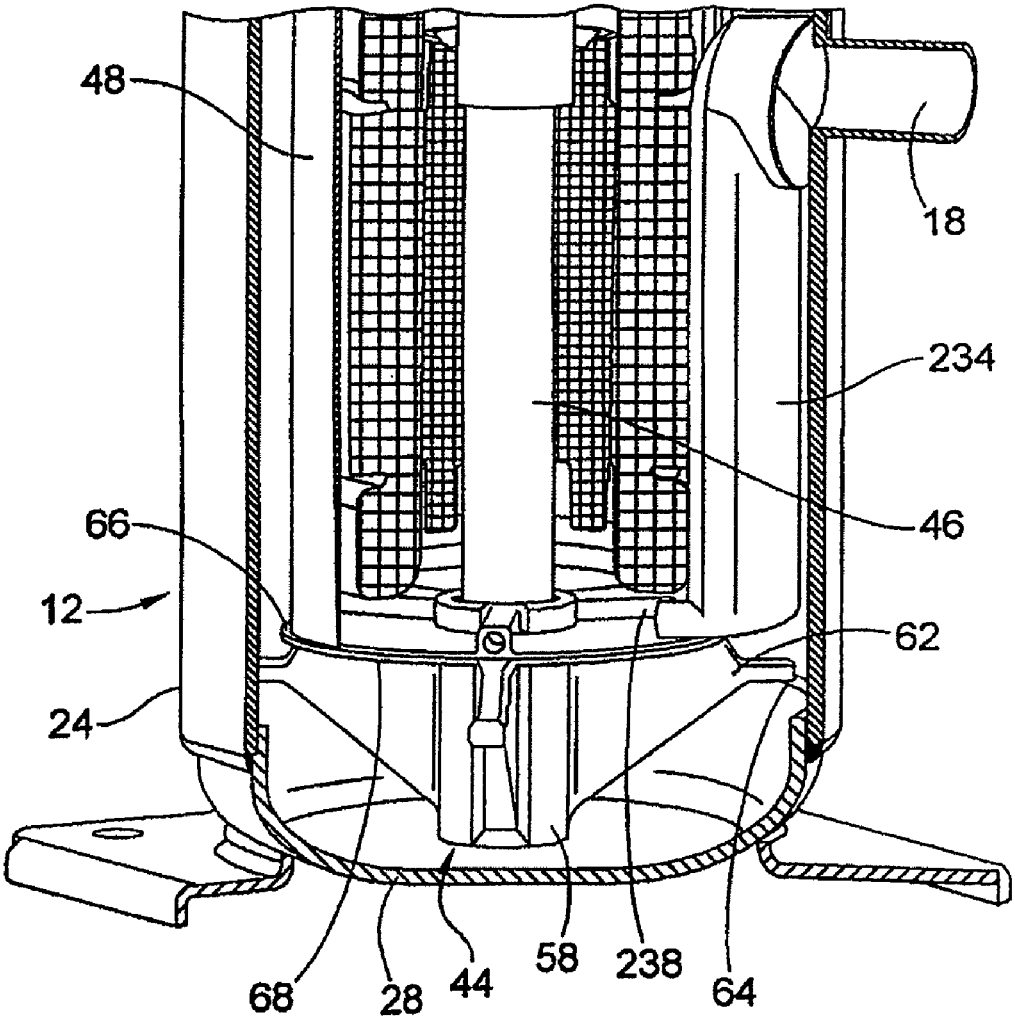
FIG. 4 is a partial cross section and cut-away view of a lower portion of the embodiment of FIG. 1.

With reference to FIGS. 1 and 4, the lower bearing member 44 includes a central generally cylindrical hub 58 that includes a central bushing and opening to provide a cylindrical bearing 60 to which the drive shaft 46 is journaled for rotational support. A plurality of arms 62 and typically at least three arms project radially outward from the bearing central hub 58 preferably at equally spaced angular intervals. These support arms 62 engage and are seated on a circular seating surface 64 provided by the terminating circular edge of the bottom side wall region 34 of the bottom outer housing section 28. As such, the bottom housing section 28 can serve to locate, support and seat the lower bearing member 44 and thereby serves as a base upon which the internal components of the scroll compressor assembly can be supported.

The lower bearing member 44 in turn supports the cylindrical motor housing 48 by virtue of a circular seat 66 formed on a plate-like ledge region 68 of the lower bearing member 44 that projects outward along the top of the central hub 58. The support arms 62 also preferably are closely toleranced relative to the inner diameter of the central housing section. The arms 62 may engage with the inner diameter surface of the central housing section 24 to centrally locate the lower bearing member 44 and thereby maintain position of the central axis 54. This can be by way of an interference and press-fit support arrangement between the lower bearing member 44 and the outer housing 12 (See e.g. FIG. 4). Alternatively according to a more preferred configuration, as shown in FIG. 1, the lower bearing engages with the lower housing section 28 which is in turn attached to center section 24. Likewise, the outer motor housing 48 may be supported with an interference and press-fit along the stepped seat 66 of the lower bearing member 44. As shown, screws may be used to securely fasten the motor housing to the lower bearing member 44.

The drive shaft 46 is formed with a plurality of progressively smaller diameter sections 46*a*-46*d* which are aligned concentric with the central axis 54. The smallest diameter section 46*d* is journaled for rotation within the lower bearing member 44 with the next smallest section 46*c* providing a step 72 for axial support of the drive shaft 46 upon the lower bearing member 44. The largest section 46*a* is journaled for rotation within the upper bearing member 42.

The drive shaft 46 further includes an offset eccentric drive section 74 that has a cylindrical drive surface 75 about an offset axis that is offset relative to the central axis 54. This offset drive section 74 is journaled within a cavity of the movable scroll member of the scroll compressor 14 to drive the movable member of the scroll compressor about an orbital path when the drive shaft 46 is spun about the central axis 54. To provide for lubrication of all of these bearing surfaces, the outer housing 12 provides an oil lubricant sump 76 at the bottom end in which suitable oil lubricant is provided. The drive shaft 46 has an oil lubricant pipe and impeller 78 that acts as an oil pump when the drive shaft is spun and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 includes various radial passages as shown to feed oil through centrifugal force to appropriate bearing surfaces and thereby lubricate sliding surfaces as may be desired.

The upper bearing member 42 includes a central bearing hub 84 into which the largest section 46*a* of the drive shaft 46 is journaled for rotation. Extending outward from the bearing hub 84 is a support web 86 that merges into an outer peripheral support rim 88. Provided along the support web 86 is an annular stepped seating surface 90 which may have an interference and press-fit with the top end of the cylindrical motor housing 48 to thereby provide for axial and radial location. The motor housing 48 may also be fastened with screws to the upper bearing member 42. The outer peripheral support rim 88 also may include an outer annular stepped seating surface 92 which may have an interference and press-fit with the outer housing 12. For example, the outer peripheral rim 88 can engage the seating surface 92 axially, that is it engages on a lateral plane perpendicular to axis 54 and not through a diameter. To provide for centering there is provided a diametric fit just below the surface 92 between the central housing section 24 and the support rim 88. Specifically, between the telescoped central and top-end housing sections 24, 26 is defined in internal circular step 94, which is located axially and radially with the outer annular step 92 of the upper bearing member 42.

The upper bearing member 42 also provides axial thrust support to the movable scroll member through a bearing support via an axial thrust surface 96. While this may be integrally provided by a single unitary component, it is shown as being provided by a separate collar member 98 that is interfit with the upper portion of the upper bearing member 42 along stepped annular interface 100. The collar member 98 defines a central opening 102 that is a size large enough to provide for receipt of the eccentric offset drive section 74 and allow for orbital eccentric movement thereof that is provided within a receiving portion of the movable scroll compressor member 112.

Turning in greater detail to the scroll compressor 14, the scroll compressor body is provided by first and second scroll compressor bodies which preferably include a relatively stationary first scroll compressor member 110 and a second scroll compressor member 112 movable relative to the first scroll compressor member 110. The second scroll compressor member 112 is arranged for orbital movement relative to the first scroll compressor member 110 for the purpose of compressing refrigerant. The first scroll compressor member includes a first rib 114 projecting axially from a plate-like base 116 and is designed in the form of a spiral. Similarly, the second movable scroll compressor body 112 includes a second scroll rib 118 projecting axially from a plate-like base 120 and is in the design form of a similar spiral. The scroll ribs 114, 118 engage in one another and abut sealingly on the respective base surfaces 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 2-3). Following the progressive compression in the chambers 122 (as the chambers progressively are defined radially inward), the refrigerant exits via a discharge port 126 which is defined centrally within the base 116 of the first scroll compressor member 110. Refrigerant that has been compressed to a high pressure can exit the chambers 122 via the discharge port 126 during operation of the scroll compressor.

The movable scroll compressor body 112 engages the eccentric offset drive section 74 of the drive shaft 46. More specifically, the receiving portion of the movable scroll compressor body 112 includes a cylindrical bushing drive hub 128 which slideably receives the eccentric offset drive section 74 with a slideable bearing surface provided therein. In detail, the eccentric offset drive section 74 engages the cylindrical drive hub 128 in order to move the second scroll compressor member 112 about an orbital path about the central axis 54 during rotation of the drive shaft 46 about the central axis 54.

Considering that this offset relationship causes a weight imbalance relative to the central axis 54, the assembly preferably includes a counter weight 130 that is mounted at a fixed angular orientation to the drive shaft 46. The counter weight 130 acts to offset the weight imbalance caused by the eccentric offset drive section 74 and the movable scroll compressor body 112 that is driven about an orbital path (e.g. among other things, the scroll rib is not equally balanced). The counter weight 130 includes an attachment collar 132 and an offset weight region 134 (see counter weight shown best in FIG. 2) that provides for the counter weight effect and thereby balancing of the overall weight of the rotating components about the central axis 54 in cooperation with a lower counterweight 135 for balancing purposes. This provides for reduced vibration and noise of the overall assembly by internally balancing or canceling out inertial forces.

Figure 2:
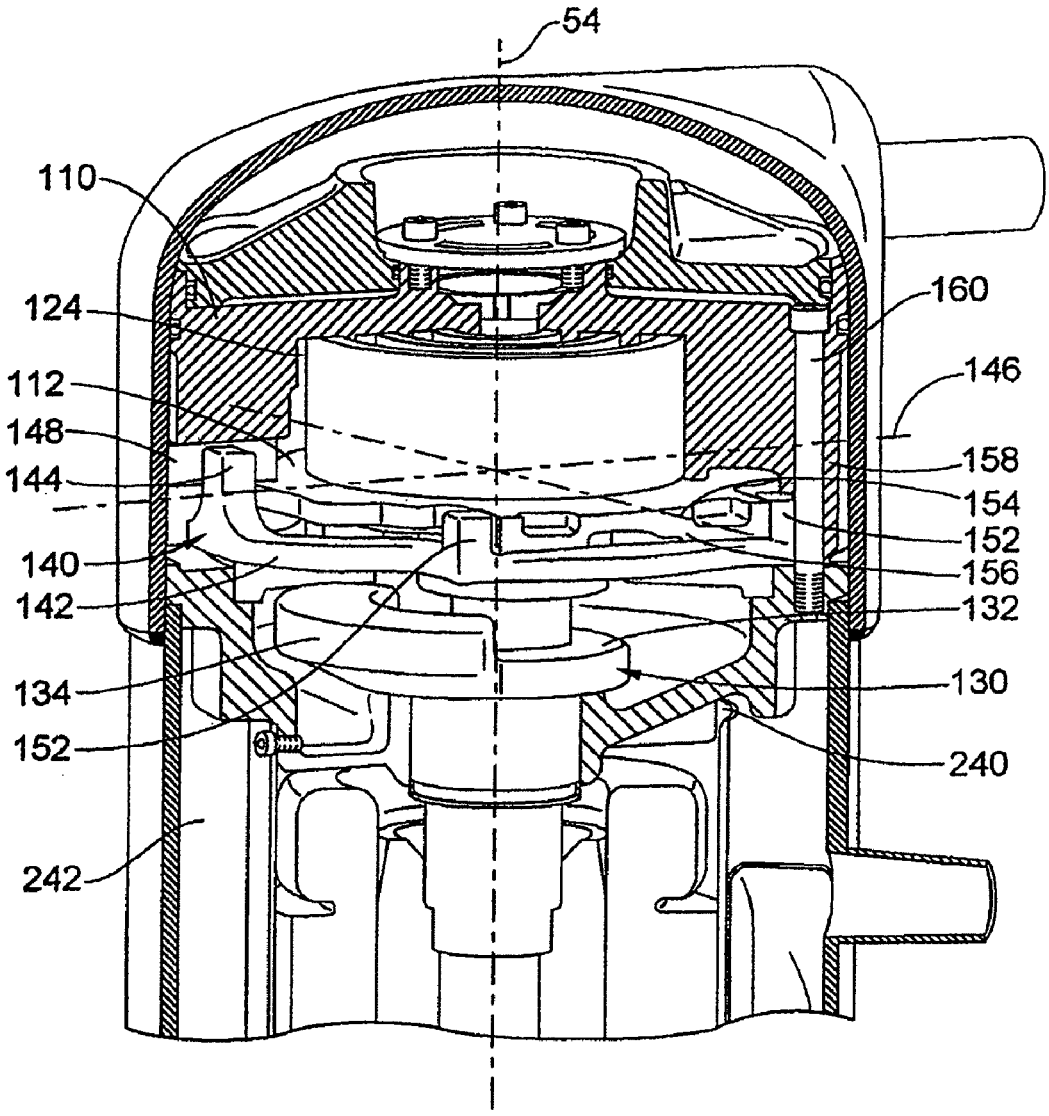
FIG. 2 is a partial cross section and cut-away view of an isometric drawing of an upper portion of the scroll compressor embodiment shown in FIG. 1.
Figure 3:
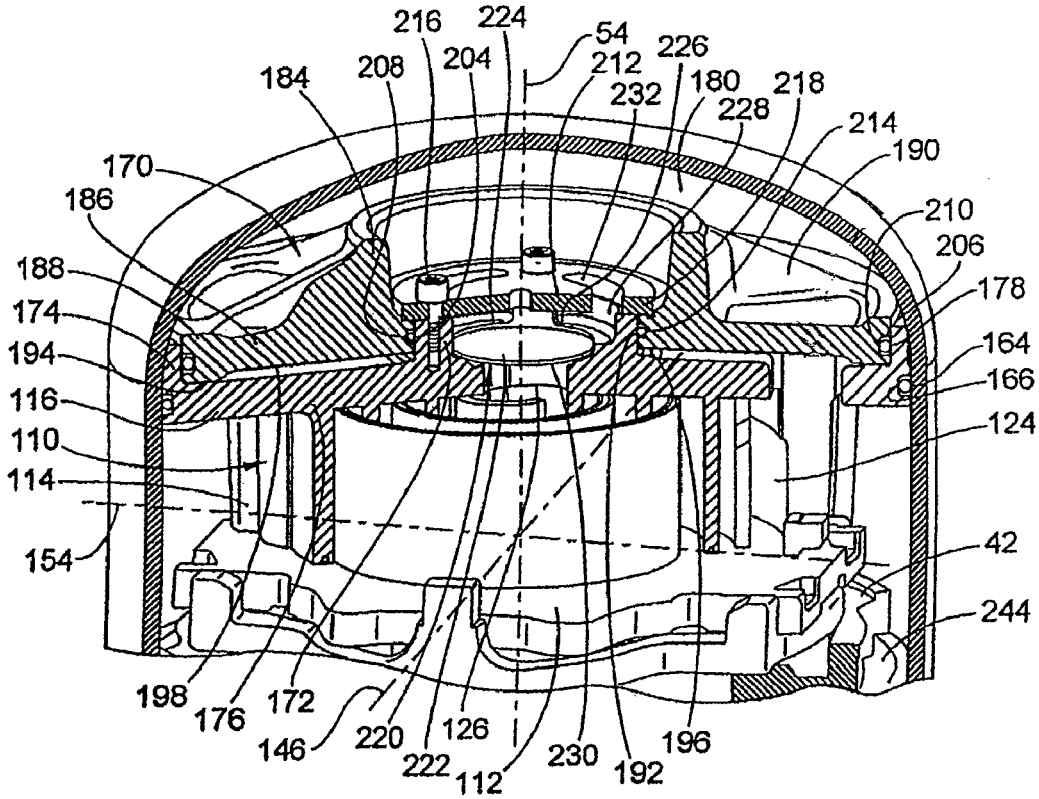
FIG. 3 is a similar view to FIG. 2 but enlarged and taken about a different angle and section in order to show other structural features.

With reference to FIGS. 1-3, and particularly FIG. 2, the guiding movement of the scroll compressor can be seen. To guide the orbital movement of the movable scroll compressor body 112 relative to the first scroll compressor member 110, an appropriate key coupling 140 may be provided. Keyed couplings are often referred to in the scroll compressor art as an "Oldham Coupling." In this embodiment, the key coupling 140 includes an outer ring body 142 and includes two first keys 144 that are linearly spaced along a first lateral axis 146 and that slide closely and linearly within two respective keyway tracks 148 that are linearly spaced and aligned along the first axis 146 as well. The key way tracks 148 are defined by the stationary first scroll compressor member 110 such that the linear movement of the key coupling 140 along the first lateral axis 146 is a linear movement relative to the outer housing 12 and perpendicular to the central axis 54. The keys can comprise slots, grooves or, as shown, projections which project from the ring body 142 of the key coupling 140. This control of movement over the first lateral axis 146 guides part of the overall orbital path of the second scroll compressor member 112.

Additionally, the key coupling includes four second keys 152 in which opposed pairs of the second keys 152 are linearly aligned substantially parallel relative to a second traverse lateral axis 154 that is perpendicular to the first lateral axis 146. There are two sets of the second keys 152 that act cooperatively to receive projecting sliding guide portions 156 that project from the base 120 on opposite sides of the movable scroll compressor body 112. The guide portions 156 linearly engage and are guided for linear movement along the second traverse lateral axis by virtue of sliding linear guiding movement of the guide portions 156 along sets of the second keys 152.

By virtue of the key coupling 140, the second scroll compressor member 112 has movement restrained relative to the first scroll compressor member 110 along the first lateral axis 146 and second traverse lateral axis 154. This results in the prevention of any relative rotation of the moveable scroll body as it allows only translational motion. More particularly, the first scroll compressor member 110 limits motion of the key coupling 140 to linear movement along the first lateral axis 146; and in turn, the key coupling 140 when moving along the first lateral axis 146 carries the moveable scroll 112 along the first lateral axis 146 therewith. Additionally, the movable scroll compressor body can independently move relative to the key coupling 140 along the second traverse lateral axis 154 by virtue of relative sliding movement afforded by the guide portions 156 which are received and slide between the second keys 152. By allowing for simultaneous movement in two mutually perpendicular axes 146, 154, the eccentric motion that is afforded by the eccentric offset drive section 74 of the drive shaft 46 upon the cylindrical drive hub 128 of the movable scroll compressor body 112 is translated into an orbital path movement of the movable scroll compressor body 112 relative to the first scroll compressor member 110.

Referring in greater detail to the first scroll compressor member 110, this body 110 is fixed to the upper bearing member 42 by an extension extending axially and vertically therebetween and around the outside of the second scroll compressor member 112. In the illustrated embodiment, the first scroll compressor member 110 includes a plurality of axially projecting legs 158 (see FIG. 2) projecting on the same side as the scroll rib from the base 116. These legs 158 engage and are seated against the top side of the upper bearing member 42. Preferably, bolts 160 (FIG. 2) are provided to fasten the first scroll compressor member 110 to the upper bearing member 42. The bolts 160 extend axially through the legs 158 of the first scroll compressor member and are fastened and screwed into corresponding threaded openings in the upper bearing member 42.

For further support and fixation of the first scroll compressor member 110, the outer periphery of the first scroll compressor member includes a cylindrical surface 162 that is closely received against the inner cylindrical surface of the outer housing 12 and more particularly the top end housing section 26. A clearance gap between surface 162 and side wall 32 serves to permit assembly of upper housing 26 over the compressor assembly and subsequently to contain the o-ring seal 164. An O-ring seal 164 seals the region between the cylindrical locating surface 162 and the outer housing 12 to prevent a leak path from compressed high pressure fluid to the un-compressed section/sump region inside of the outer housing 12. The seal 164 can be retained in a radially outward facing annular groove 166.

With reference to FIGS. 1-3 and particularly FIG. 3, the upper side (e.g. the side opposite the scroll rib) of the fixed scroll 110 supports a floatable baffle member 170. To accommodate the same, the upper side of the first scroll compressor member 110 includes an annular and more specifically cylindrical inner hub region 172 and an outwardly spaced peripheral rim 174 which are connected by radially extending disc region 176 of the base 116. Between the hub 172 and the rim 174 is provided an annular piston-like chamber 178 into which the baffle member 170 is received. With this arrangement, the combination of the baffle member 170 and the first scroll compressor member 110 serve to separate a high pressure chamber 180 from lower pressure regions within the housing 12. While the baffle member 170 is shown as engaging and constrained radially within the outer peripheral rim 174 of the first scroll compressor member 110, the baffle member 170 could alternatively be cylindrically located against the inner surface of the outer housing 12 directly.

As shown in the embodiment, and with particular reference to FIG. 3, the baffle member 170 includes an inner hub region 184, a disc region 186 and an outer peripheral rim region 188. To provide strengthening, a plurality of radially extending ribs 190 extending along the top side of the disc region 186 between the hub region 184 and the peripheral rim region 188 may be integrally provided and are preferably equally angularly spaced relative to the central axis 54. The baffle member 170 in addition to tending to separate the high pressure chamber 180 from the remainder of the outer housing 12 also serves to transfer pressure loads generated by high pressure chamber 180 away from the inner region of the first scroll compressor member 110 and toward the outer peripheral region of the first scroll compressor member 110.

At the outer peripheral region, pressure loads can be transferred to and carried more directly by the outer housing 12 and therefore avoid or at least minimize stressing components and substantially avoid deformation or deflection in working components such as the scroll bodies. Preferably, the baffle member 170 is floatable relative to the first scroll compressor member 110 along the inner peripheral region. This can be accomplished, for example, as shown in the illustrated embodiment by a sliding cylindrical interface 192 between mutually cylindrical sliding surfaces of the first scroll compressor member and the baffle member along the respective hub regions thereof.

As compressed high-pressure refrigerant in the high-pressure chamber 180 acts upon the baffle member 170, substantially no load may be transferred along the inner region, other than as may be due to frictional engagement. Instead, an axial contact interface ring 194 is provided at the radial outer periphery where the respective rim regions are located for the first scroll compressor member 110 and the baffle member 170. Preferably, an annular axial gap 196 is provided between the innermost diameter of the baffle member 170 and the upper side of the first scroll compressor member 110. The annular axial gap 196 is defined between the radially innermost portion of the baffle member and the scroll member and is adapted to decrease in size in response to a pressure load caused by high pressure refrigerant compressed within the high pressure chamber 180. The gap 196 is allowed to expand to its relaxed size upon relief of the pressure and load.

To facilitate load transfer most effectively, an annular intermediate or lower pressure chamber 198 is defined between the baffle member 170 and the first scroll compressor member 110. This intermediate or lower pressure chamber can be subject to either the lower sump pressure as shown, or can be subject to an intermediate pressure (e.g. through a fluid communication passage defined through the first scroll compressor member to connect one of the individual compression chambers 122 to the chamber 198). Load carrying characteristics can therefore be configured based on the lower or intermediate pressure that is selected for best stress/deflection management. In either event, the pressure contained in the intermediate or low pressure chamber 198 during operation is substantially less than the high pressure chamber 180 thereby causing a pressure differential and load to develop across the baffle member 170.

To prevent leakage and to better facilitate load transfer, inner and outer seals 204, 206 may be provided, both of which may be resilient, elastomeric O-ring seal members. The inner seal 204 is preferably a radial seal and disposed in a radially inwardly facing inner groove 208 defined along the inner diameter of the baffle member 170. Similarly the outer seal 206 can be disposed in a radially outwardly facing outer groove 210 defined along the outer diameter of the baffle member 170 in the peripheral rim region 188. While a radial seal is shown at the outer region, alternatively or in addition an axial seal may be provided along the axial contact interface ring 194.

While the baffle member 170 could be a stamped steel component, preferably and as illustrated, the baffle member 170 comprises a cast and/or machined member (and may be aluminum) to provide for the expanded ability to have several structural features as discussed above. By virtue of making the baffle member in this manner, heavy stamping of such baffles can be avoided.

Additionally, the baffle member 170 can be retained to the first scroll compressor member 110. Specifically, as can be seen in the figures, a radially inward projecting annular flange 214 of the inner hub region 184 of the baffle member 170 is trapped axially between the stop plate 212 and the first scroll compressor member 110. The stop plate 212 is mounted with bolts 216 to a first scroll compressor member 110. The stop plate 212 includes an outer ledge 218 that projects radially over the inner hub 172 of the first scroll compressor member 110. The stop plate ledge 218 serves as a stop and retainer for the baffle member 170. In this manner, the stop plate 212 serves to retain the baffle member 170 to the first scroll compressor member 110 such that the baffle member 170 is carried thereby.

As shown, the stop plate 212 can be part of a check valve 220. The check valve includes a moveable valve plate element 222 contained within a chamber defined in the outlet area of the first scroll compressor member within the inner hub 172. The stop plate 212 thus closes off a check valve chamber 224 in which the moveable valve plate element 222 is located. Within the check valve chamber there is provided a cylindrical guide wall surface 226 that guides the movement of the check valve 220 along the central axis 54. Recesses 228 are provided in the upper section of the guide wall 226 to allow for compressed refrigerant to pass through the check valve when the moveable valve plate element 222 is lifted off of the valve seat 230. Openings 232 are provided in the stop plate 212 to facilitate passage of compressed gas from the scroll compressor into the high pressure chamber 180. The check valve is operable to allow for one way directional flow such that when the scroll compressor is operating, compressed refrigerant is allowed to leave the scroll compressor bodies through the discharge port 126 by virtue of the valve plate element 222 being driven off of its valve seat 230. However, once the drive unit shuts down and the scroll compressor is no longer operating, high pressure contained within the high pressure chamber 180 forces the movable valve plate element 222 back upon the valve seat 230. This closes off check valve 220 and thereby prevents backflow of compressed refrigerant back through the scroll compressor.

During operation, the scroll compressor assembly 10 is operable to receive low pressure refrigerant at the housing inlet port 18 and compress the refrigerant for delivery to the high pressure chamber 180 where it can be output through the housing outlet port 20. As is shown, in FIG. 4, an internal conduit 234 can be connected internally of the housing 12 to guide the lower pressure refrigerant from the inlet port 18 into the motor housing via a motor housing inlet 238. This allows the low pressure refrigerant to flow across the motor and thereby cool and carry heat away from the motor which can be caused by operation of the motor. Low pressure refrigerant can then pass longitudinally through the motor housing and around through void spaces therein toward the top end where it can exit through a plurality of motor housing outlets 240 (see FIG. 2) that are equally angularly spaced about the central axis 54.

The motor housing outlets 240 may be defined either in the motor housing 48, the upper bearing member 42 or by a combination of the motor housing and upper bearing member (e.g. by gaps formed therebetween as shown in FIG. 2). Upon exiting the motor housing outlet 240, the low pressure refrigerant enters an annular chamber 242 formed between the motor housing and the outer housing. From there, the low pressure refrigerant can pass through the upper bearing member through a pair of opposed outer peripheral through ports 244 that are defined by recesses on opposed sides of the upper bearing member 42 to create gaps between the bearing member 42 and housing 12 as shown in FIG. 3 (or alternatively holes in bearing member 42).

The through ports 244 may be angularly spaced relative to the motor housing outlets 240. Upon passing through the upper bearing member 42, the low pressure refrigerant finally enters the intake area 124 of the scroll compressor bodies 110, 112. From the intake area 124, the lower pressure refrigerant finally enters the scroll ribs 114, 118 on opposite sides (one intake on each side of the first scroll compressor member) and is progressively compressed through chambers 122 to where it reaches it maximum compressed state at the discharge port 126 where it subsequently passes through the check valve 220 and into the high pressure chamber 180. From there, high pressure compressed refrigerant may then pass from the scroll compressor assembly 10 through the refrigerant housing outlet port 20.

An embodiment may include an extended thrust region for carrying axial loads when the scroll compressor bodies 110, 112 are axially urged together. For example, the scroll bodies can be axially forced together in the event of improper installation (e.g. reverse wiring) which would cause reverse operation and a vacuum condition between the scroll bodies.

Figure 5:
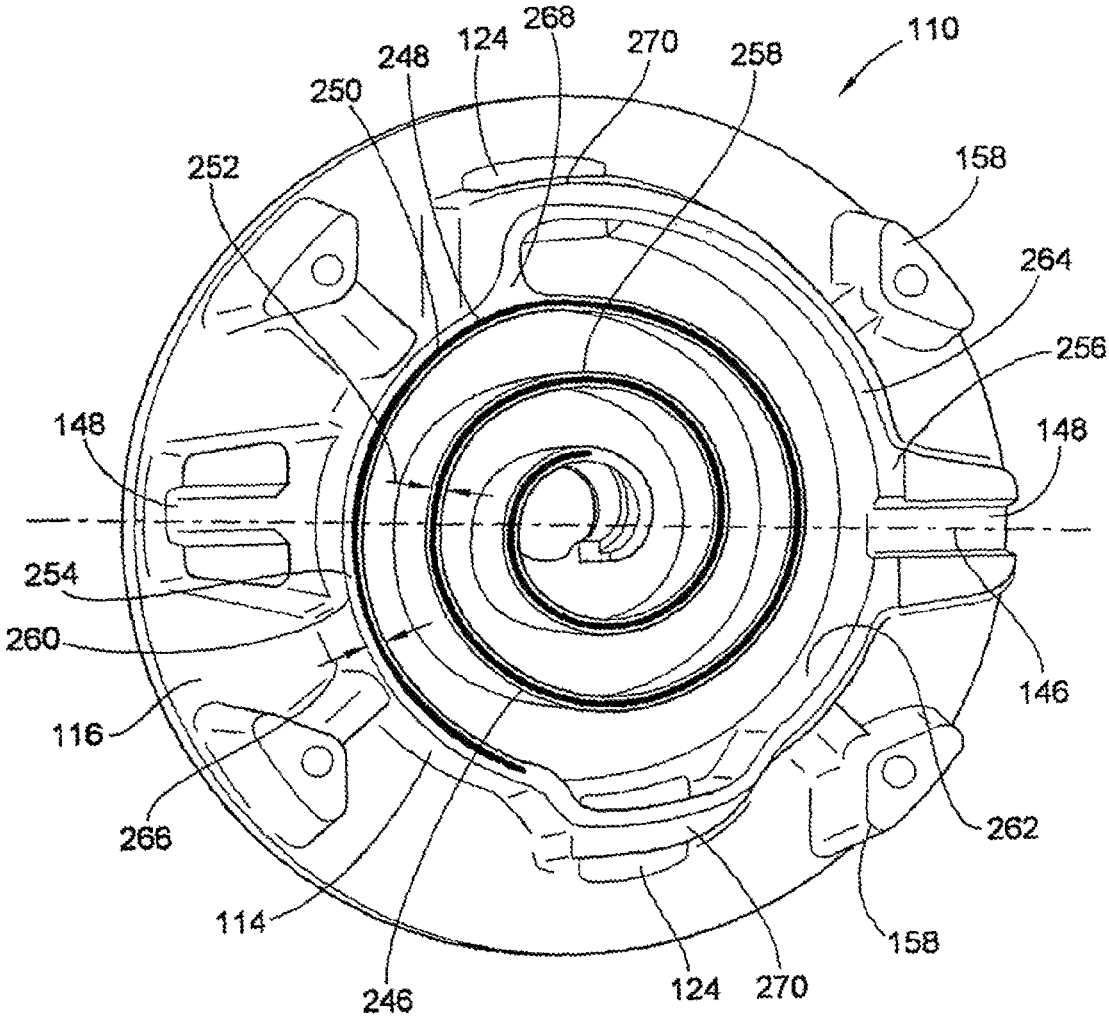
FIG. 5 is an isometric view of generally the bottom side of the first scroll compressor member showing an extended reversed thrust zone in accordance with an embodiment of the present invention.
Figure 6:
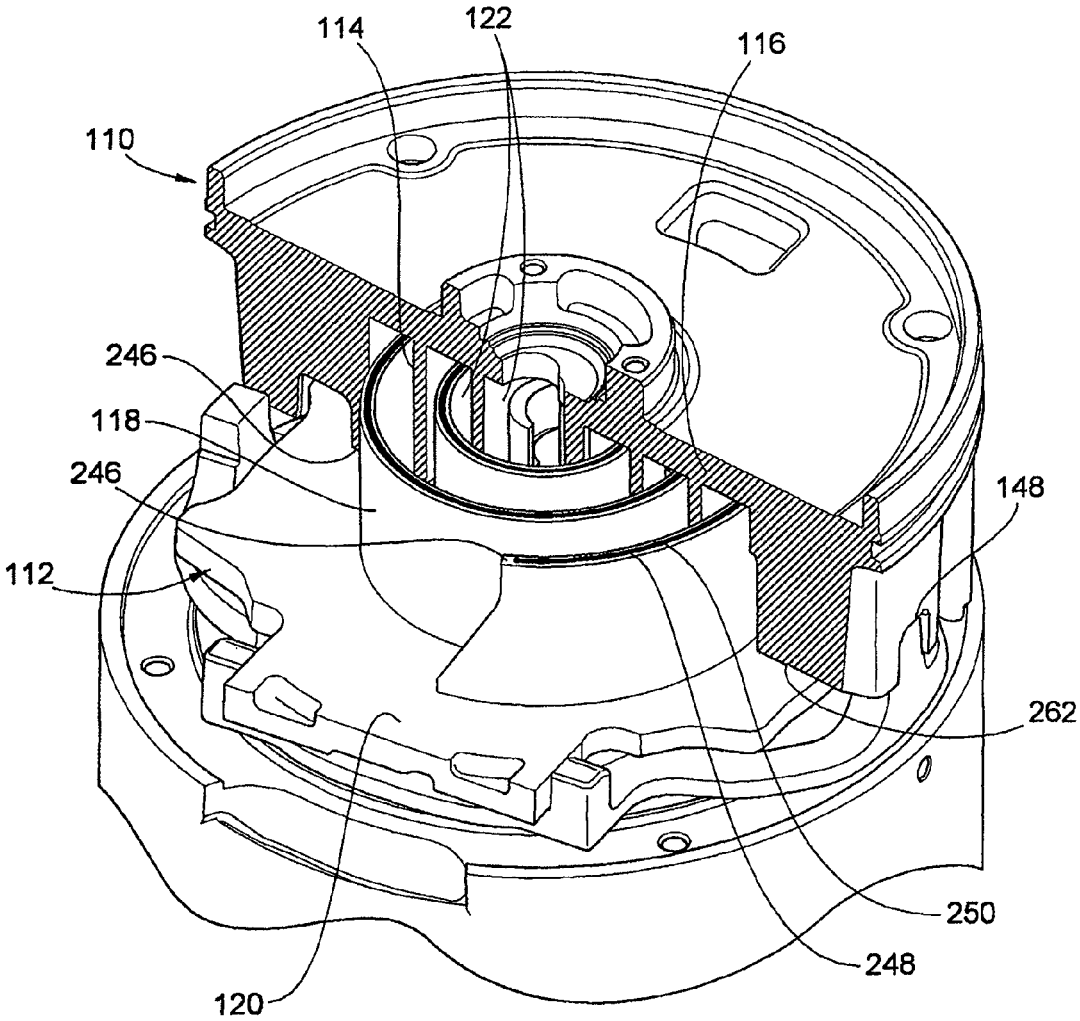
FIG. 6 is a partial cross section and cut away of an isometric view generally of the scroll compressor bodies.
Figure 7A:
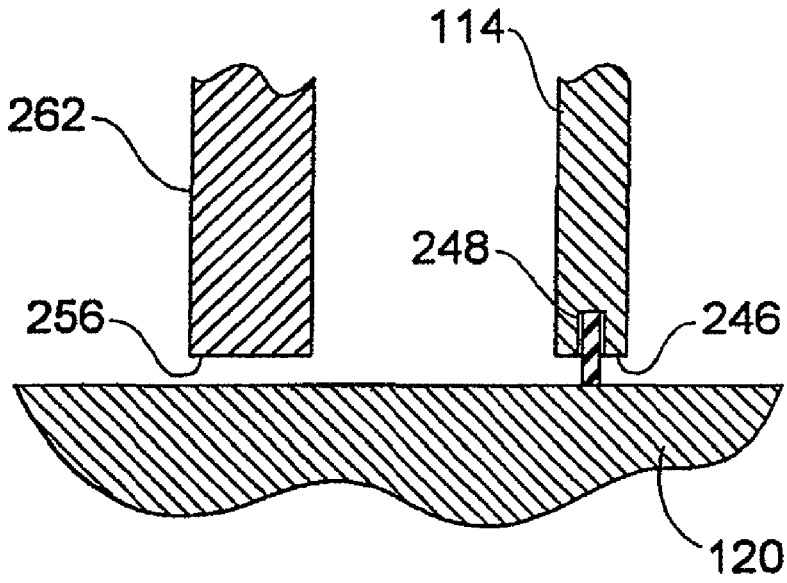
FIGS. 7*a* and 7*b* are cross sections through a scroll rib with two slightly different variations (exaggerated or not to scale for demonstrative purposes) showing elevations of the extended thrust region relative to sealing tip regions.
Figure 7B:
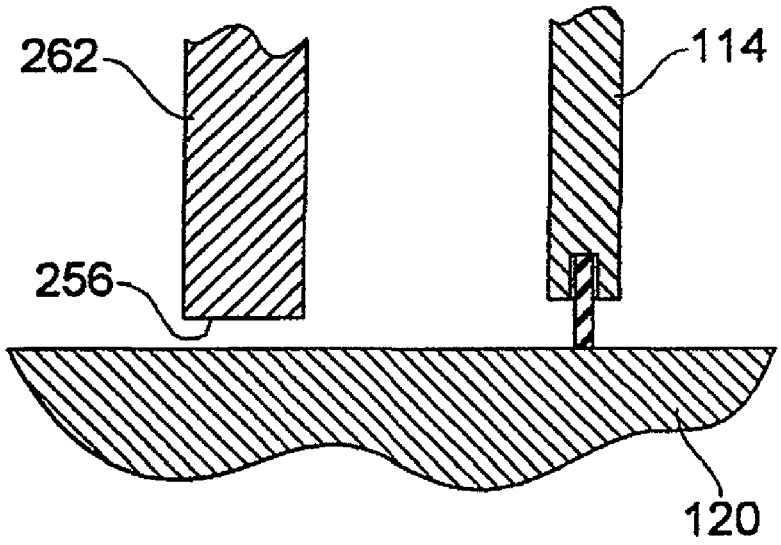

The extended thrust region is shown best in FIG. 5, with additional reference to FIGS. 6, 7*a* and 7*b*. As shown therein, the tips 246 of each scroll rib 114, 118 define a spiral groove 248 (See e.g., also FIG. 7*a* and 7*b*) in which a tip seal 250 is secured. The tip seal 250, which may be spiral-shaped, projects axially from its tip 246 and engages the base of the other scroll body. This provides for sealing and prevention of pressure loss between compression chambers 122 which are formed between respective scroll ribs 114, 118. Specifically, the tip seals 250 engage the compressor body bases 116, 120 to provide an axial seal therebetween and thereby prevent fluid leakage along this region past the scroll tips from high pressure inner chambers 122 to lower pressure outer chambers 122 on the outer sides of the scroll ribs 114, 118 at any given location. The seal may or may not be compressed when the scrolls are pulled together. Specifically, the axial height of the seal may be equal to or less than the groove depth so that the seal has room to move completely into the groove. Additionally, some commercially successful tip seal designs are made of metal and are not resilient. An embodiment of the present invention is applicable to all such tip seal alternatives.

As can be seen best in FIG. 5, it is desirable and beneficial to maintain a relatively thin scroll tip width shown at 252, for each of the scroll ribs 114, 118. As a consequence and due to the spiral groove 248 facilitating retention of the tip seal 250, the surface area or scroll tip face 254 which faces the base of the other scroll body has a smaller surface area and is divided into thinner metal regions on either side of the tip seal 250.

As such, to carry axial loads in the event the scroll bodies are urged axially together, the embodiment includes an extended thrust zone 256 that extends around an inner sealing region 258 of the scroll rib 114. Preferably, and as shown, the extended thrust zone is provided by the fixed scroll compressor body 110. This thrust zone 256 is generally annular and surrounds the inner sealing region 258. By "surrounds", it is meant to extend generally around, and preferably continuously except for perhaps small interruptions due to, for example, the key way tracks 148 which are provided facilitate or guide movement along the first lateral axis 146 or other such interruptions.

The thrust zone 256 may generally include two different regions including one region that provides for sealing, namely an outer sealing region 260 and a non-sealing region provided by a thrust rib 262 that is notably free of any tip sealing and instead merely provides for a thrust face 264. As can be generally seen in FIG. 5, the outer sealing region 260 has a wider scroll tip face indicated at 266 relative to the scroll tip width 252 indicated for the inner sealing region 258. The outer sealing region 260 is provided and permitted to be wider on the outside of the spiral tip seal 250 considering that the scroll rib 118 of the moveable scroll compressor body 112 is received along the inside only as opposed to the outside of this portion of the fixed scroll rib 114. Thus, a wider tip face along the outer sealing region 260 is accommodated. The inner and outer sealing regions are generally joined or differentiated by intersection 268 which leads along the extended wider thrust face 264 to the seal free thrust rib 262.

Further, the thrust zone 256 and thrust face 264 preferably extend over bridges 270 which are disposed on opposite sides of the stationary scroll compressor body 110. The bridges 270 connect the scroll rib 114 with the thrust rib 262 and bridge the gap therebetween where inlet openings are provided to facilitate the intake areas 124 whereat refrigerant may enter the scroll compressor bodies for eventual progressive compression. As shown, the thrust rib 262 has a shape of a portion of an outer scroll wrap so as to accommodate the outer portion of the movable scroll rib 118 which is received inside thereof.

While the extended thrust zone features can be provided upon either or both of the scroll compressor bodies 110, 112, preferably the extended thrust zone 256 is provided on the fixed scroll compressor body 110 as illustrated. In this case, with the mounting legs 158 provided, the thrust zone 256 is generally contained within the confines of at least the diameter whereat the legs 158 are provided as a group.

Turning to FIGS. 7*a* and 7*b*, it is shown that the extended thrust zone may lie either in the same place as the scroll rib tip 246 as in FIG. 7*a*, or may be slightly raised more as in FIG. 7*b* to a relative elevation intermediate to the extent of the tip seal and the scroll rib tip 246. Again however, for other embodiments, the tip seal may not axially project from the groove.

Figure 8A:
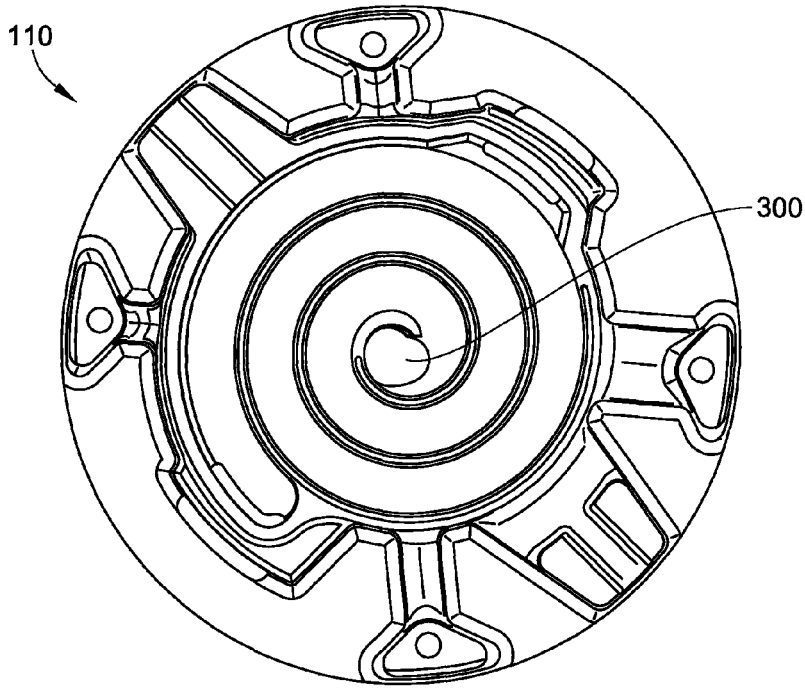
FIG. 8A (PRIOR ART)
FIG. 8A is an isometric view of the scroll compressor member according to an embodiment of the invention.
Figure 8B:
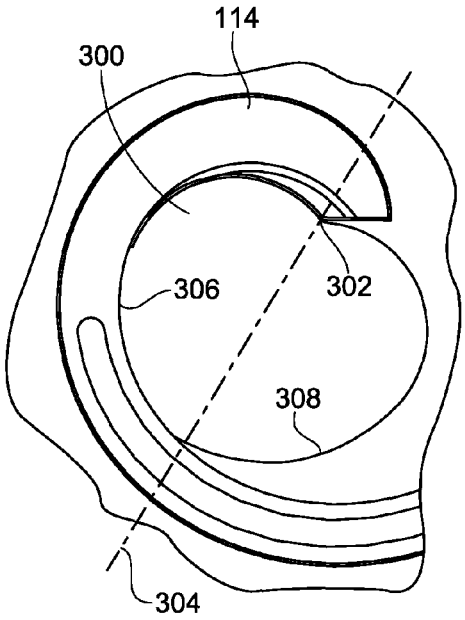
FIG. 8B (PRIOR ART)
FIG. 8B is a close-up view of a conventional discharge port which could be incorporated in the scroll compressor member of FIG. 8A.
Figure 8C:
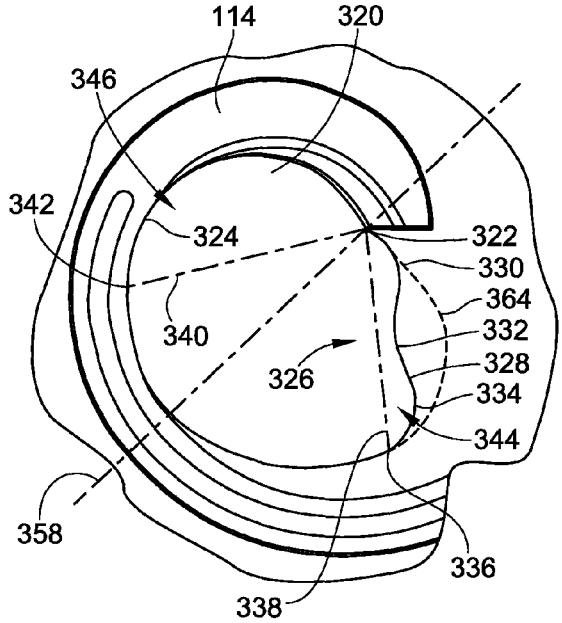
FIG. 8C is a close-up view of an optimized discharge port which could be incorporated in the scroll compressor member of FIG. 8A according to an embodiment of the invention.

Turning now to the improved tip sealing and discharge port arrangement 11, attention will now be afforded to FIGS. 8A, 8B, 8C, and 9. For purposes of perspective and comparison, discussion about a more conventional discharge port 300 arrangement will also be provided. FIG. 8A is an isometric view of the first scroll compressor member 110 with a conventional discharge port 300. FIG. 8B is an enlarged view of the conventional discharge port 300, while FIG. 8C shows an enlarged view of an optimized discharge port 320, according to an embodiment of the invention. The conventional discharge port 300 includes a vertex 302. With the conventional discharge port 300, an axis of general symmetry 304 can be drawn through the vertex 302 such that the axis of general symmetry 304 separates the conventional discharge port 300 into two halves having substantial symmetry (i.e., wherein the two halves are not equal but have a similar shape) such that a first flow area 306 is similar in size and shape to a second flow area 308.

FIG. 8C shows an embodiment of an optimized discharge port 320 configured to permit the use of a spiral tip seal 250 on the scroll tip 246, wherein the length of the spiral tip seal 250 in the vicinity of the optimized discharge port 320 is greater than could be used with the conventional discharge port 300. Optimized discharge port 320 includes a vertex 322 and a first edge portion 324 that extends from the vertex 322 along the inside of the first scroll rib 114, and generally follows the curvature of the first scroll rib 114. The optimized discharge port 320 also includes a receding region 326. In an embodiment of the invention, the receding region 326 has a second edge portion 328 that includes a first outward-projecting portion 330 extending from the vertex 322. An intermediate inward-projecting portion 332 has a curvature with a radius that faces a direction opposite all of the other radii from which the optimized discharge port 320 is constructed, and extends from the first outward-projecting portion 330, and leads to a second outward-projecting portion 334 extending from the intermediate inward-projecting portion 332. The intermediate inward-projecting portion 332 has a radius whose center (not shown) is outside of the optimized discharge port 320. The second outward-projecting portion 334 extends from the intermediate inward-projecting portion 332 to the end of the receding region 326. It is also contemplated that, in alternate embodiments, the receding region 326 may have a substantially linear portion connecting the first and second outward-projecting portions 330, 334, or other shape that sufficiently avoids an orbiting scroll tip seal path 348.

Regardless of the particular shape of the second edge portion 328, the receding region 326 represents a flow area through the discharge port that is smaller than the corresponding second flow area 308 in the conventional discharge port 300. This concept is illustrated in the following example. For a selected point 336 at the end of the receding region 326, a first chord 338 connects the vertex 322 and the selected point 336. A second chord 340, equal in length to the first chord 338, extends from the vertex 322 to a second 342 point along the first edge portion 324. In one embodiment of the invention, the optimized discharge port 320 has a first flow area 344 between the first chord 338 and the second edge portion 328 is at least 25% smaller than a second flow area 346 between the second chord 340 and the first edge portion 324. In another embodiment of the invention, the first flow area 344 is at least 50% smaller than the second flow area 346. The flow area in the receding region 326 notwithstanding, each portion of the optimized discharge port 320 has substantial flow area for the discharge of the compressed refrigerant.

FIG. 9 is an enlarged view of the optimized discharge port 320 which includes an illustration of the orbiting scroll tip seal path 348 followed by an end 350 of the tip seal 250 proximate the optimized discharge port 320. In the present invention, the tip seal 250 can be lengthened to extend closer to the optimized discharge port 320 than would be possible if the scroll compressor member had the conventional discharge port 300. With the conventional discharge port 300, the circular path, or seal sweep radius, of the orbiting scroll tip seal 348 would cause part of the tip seal 250 to repeatedly pass over the edge of the discharge port 300 during compressor operation, thus damaging the tip seal 250 and reducing the efficiency of the scroll compressor. However, the intermediate inward-projecting portion 332 of the second edge portion 328 prevents overlap with a portion of the tip seal 250.

A clearance region 352, preferably an arcuate region, adequately separates the expected tip seal path and optimized discharge port 320 to accommodate operational variances. All of this permits reliable use of the extended tip seal 250 to increase compressor efficiency. Consequently, the size and location of the intermediate inward-projecting portion 332 is determined by the seal sweep radius of the orbiting scroll tip seal path 348. An alternate axis of general symmetry 358 (similar to axis of general symmetry 304 shown in FIG. 8B) goes through vertex 322, such that the alternate axis of general symmetry 358 would divide the optimized discharge port 320 into two substantially symmetrical portions 360, 362 if the portion 362 had the same shape as the conventional discharge port 300, shown by the dashed curve 364. However, the reduced flow area in the receding region 326 of optimized discharge port 320 results in portion 362 having a smaller flow area than portion 360.

Figure 10:
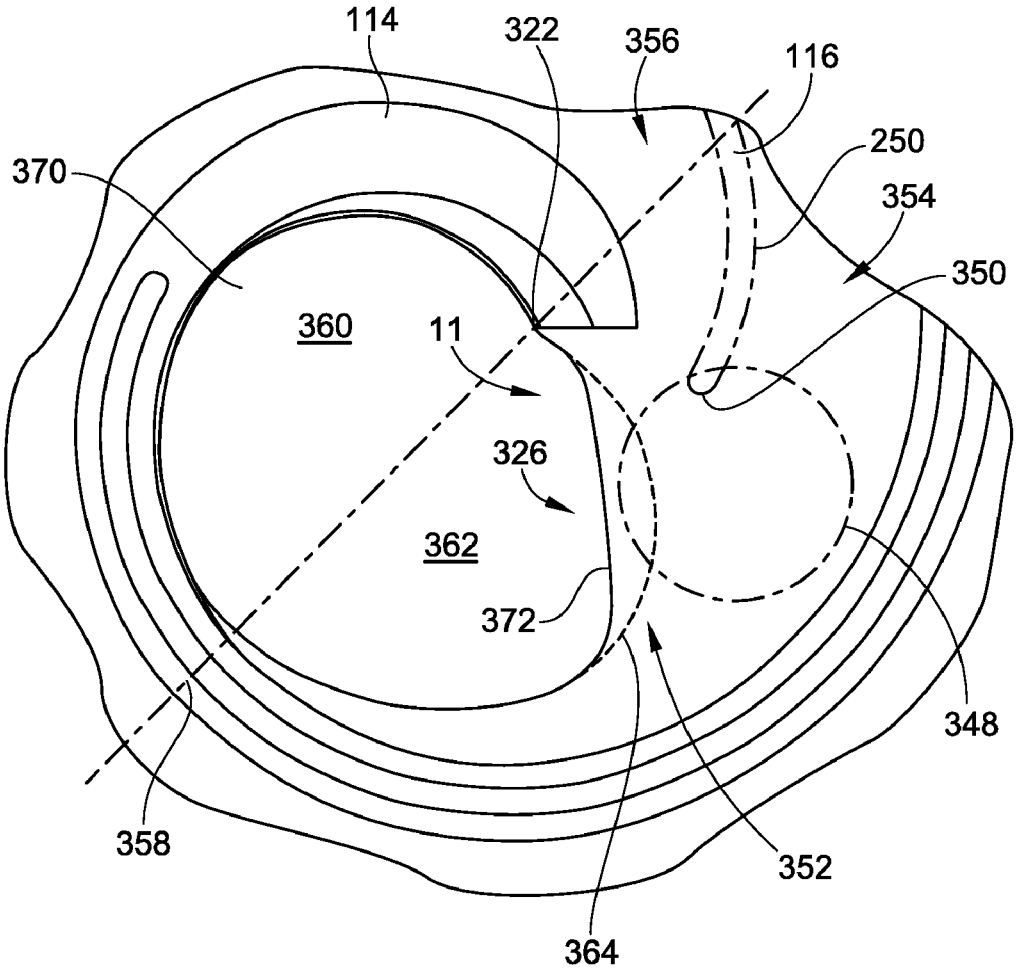
FIG. 10 is an illustration of an alternate embodiment of the optimized discharge port showing the orbiting scroll tip seal path according to an embodiment of the present invention.

While in FIG. 9, the receding region 326 is shown as an inward-facing radius, it can also be appreciated that the receding region 326 may include other shapes as well. FIG. 10 shows an alternate embodiment of the optimized discharge port 370 in which the receding region 326 includes a linear portion 372. This alternate configuration reduces the size of the clearance region 352, but still maintains an adequate space between the perimeter of the optimized discharge port 370 and the seal sweep radius of the orbiting scroll tip seal 348, and further allows for used of the extended tip seal 250 to increase compressor efficiency.

As explained above, a refrigerant is exposed to progressively higher pressures as it moves from the inlet at the perimeter of the first scroll member to the discharge port at or near the center of the scroll member. Any leakage from high-pressure regions of the scroll compressor to relatively lower-pressure regions reduces the efficiency of the compressor. The end 350 of the tip seal 250 represents a leakage path for refrigerant from a high-pressure region 354 on one side of the scroll rib 116 to a relatively lower-pressure region 356 on the other side of the scroll rib 116. Extending the tip seal 250 closer to the optimized discharge port 320 decreases the size of the aforementioned leakage path, resulting in increased efficiency of the scroll compressor.

For a 15 to 35 ton-capacity scroll compressor, the end of tip seal 350 on the moveable second scroll compressor member 112 can be spaced from approximately 32 to 35 millimeters (measured in a straight line) from the terminating end (i.e., the end near the optimized discharge port 320) of the scroll rib 118. The flow area of the optimized discharge port 320 may range from 700 to 950 square millimeters. Preferably, the clearance region 352 has a minimum span of 2.0 mm.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor for compressing fluid, comprising:

a first scroll compressor body having a first base, a first scroll rib projecting from the first base, and a discharge port;

a second scroll compressor body having a second base and a second scroll rib projecting from the second base, the first and second bases being axially spaced apart with the first and second scroll ribs mutually received in each other to define at least one compression chamber between an intake region and the discharge port, wherein relative movement between the first and second scroll compressor bodies is adapted to compress fluid from the intake region to the discharge port; and a tip seal projecting axially from the second scroll rib and adapted to sealingly engage the first base for sealing the at least one compression chamber;

wherein a shape of the discharge port includes an inward-facing radius whose center is located outside of a perimeter of the discharge port; and wherein the inward-facing radius enables a length of the tip seal in the vicinity of the discharge port to be greater than it would be absent the inward-facing radius.

2. The scroll compressor of claim 1, wherein the curvature of the inward-facing radius is opposite the direction of all other radii from which the discharge port is constructed.

3. The scroll compressor of claim 1, wherein, during operation of the scroll compressor, the first scroll compressor member is relatively stationary, and the second scroll compressor member is configured to be moveable relative to the first scroll compressor member.

4. The scroll compressor of claim 1, wherein a size and location of the inward-facing radius is determined by a seal sweep radius defined by a circular movement of an end of the tip seal.

5. The scroll compressor of claim 1, wherein the tip seal is a spiral-shaped tip seal.

6. A scroll compressor for compressing fluid, comprising:

a first scroll compressor body having a first base, a first scroll rib projecting from the first base, and a discharge port, the first scroll rib having a terminating end at the discharge port, the discharge port having a vertex generally at the terminating end;

a second scroll compressor body having a second base and a second scroll rib projecting from the second base, the first and second bases being axially spaced apart with the first and second scroll ribs mutually received in each other to define at least one compression chamber between an intake region and the discharge port, wherein relative movement between the first and second scroll compressor bodies is adapted to compress fluid from the intake region to the discharge port; and a tip seal projecting axially from the second scroll rib and adapted to sealingly engage the first base for sealing the at least one compression chamber; tip seal having a seal tip end proximate the discharge port and having scroll tip seal path during said relative movement in spaced relation to the discharge port;

the discharge port having a first edge portion extending away from the vertex inside of the first scroll rib generally following a curvature of the first scroll rib, and a second edge portion extending away from the vertex, the second edge portion having a receding region, as compared to the first edge portion, the receding region in close proximity to the scroll tip seal path to accommodate sweeping movement of the tip seal.

7. The scroll compressor claim 6, wherein the second edge portion includes:

a first outward projecting portion extending from the vertex;

an intermediate inward projecting portion extending from the first outward projecting portion; and a second outward projecting portion extending from the intermediate inward projecting portion.

8. The scroll compressor of claim 6, wherein the vertex and a selected point along the receding region comprise end points of a first chord, which in combination with the second edge portion defines a reduced flow area within the discharge port, as compared to a second flow area defined by a second chord and the first edge portion, wherein the second chord connects the vertex to a point along the first edge portion, and is equal in length to the first chord.

9. The scroll compressor of claim 8, wherein the selected point is at the end of the receding region, and the reduced flow area is at least 25% smaller than the second flow area.

10. The scroll compressor of claim 9, wherein the reduced flow area is at least 50% smaller than the second flow area.

11. The scroll compressor of claim 6, wherein the receding region includes an inward-facing radius whose center is located outside of the discharge port.

12. The scroll compressor of claim 11, wherein the inward-facing radius permits a tip seal length to be greater in the region proximate the discharge port than it would be absent the inward-facing radius.

13. The scroll compressor of claim 12, wherein a size and location of the inward-facing radius is determined by a seal sweep radius defined by a circular movement of an end of the tip seal.

14. A scroll compressor for compressing fluid, comprising:

a first scroll compressor body having a first base, a first scroll rib projecting from the first base, and a discharge port;

a second scroll compressor body having a second base and a second scroll rib projecting from the second base, the first and second bases being axially spaced apart with the first and second scroll ribs mutually received in each other to define at least one compression chamber between an intake region and the discharge port, wherein relative movement between the first and second scroll compressor bodies is adapted to compress fluid from the intake region to the discharge port; and a tip seal projecting axially from the second scroll rib and adapted to sealingly engage the first base for sealing the at least one compression chamber;

wherein the discharge port has a vertex, a radially-outward-facing region extending from one side of the vertex, and a radially-inward-facing region extending from another side of the vertex, the radially-inward-facing region configured to accommodate a sweeping movement of the tip seal into a discharge port region to enable tip seal lengthening on the second scroll rib.

15. The scroll compressor of claim 14, wherein a shape of the discharge port is defined by a perimeter edge of an opening formed into the first base proximate a path defined by the sweeping movement of the scroll tip seal.

16. The scroll compressor of claim 14, wherein a shape of the discharge port includes the radially-inward-facing region whose center is located outside of a perimeter of the discharge port; and wherein the radially-inward-facing region enables a length of the tip seal in the vicinity of the discharge port to be greater than it would be absent the radially-inward-facing region.

17. The scroll compressor of claim 14, wherein a size and location of the radially inward-facing region is determined by a seal sweep radius defined by a circular movement of an end of the tip seal.

18. The scroll compressor of claim 14, wherein the tip seal is a spiral-shaped tip seal.

* * * * *

UNITED STATES PATENT AND TRADEMARK OFFICE

CERTIFICATE OF CORRECTION

PATENT NO. : 8,297,958 B2
APPLICATION NO. : 12/557592
DATED : October 30, 2012
INVENTOR(S) : Ronald J. Duppert It is certified that error appears in the above-identified patent and that said Letters Patent is hereby corrected as shown below:

On the title page, item (73), states the incorrect Assignee as Bitzer Scroll, Inc., of Syracuse, NY (US). The correct Assignee is Bitzer Kuhlmaschinenbau GmbH, Sindelfingen, Germany.

Signed and Sealed this
Twenty-fifth Day of February, 2014

Michelle K. Lee

Michelle K. Lee
*Deputy Director of the United States Patent and Trademark Office*